US005956765A

United States Patent [19]

Chin

[11] Patent Number: 5,956,765

[45] Date of Patent: Sep. 28, 1999

[54] WHOLLY AND PARTIALLY REMOVABLE GARMENT

[76] Inventor: May Ying Chin, 22 Indian Springs Way, Wellesley, Mass. 02181

[21] Appl. No.: 08/968,891

[22] Filed: Nov. 6, 1997

Related U.S. Application Data

[60] Continuation-in-part of application No. 08/453,987, May 30, 1995, abandoned, which is a division of application No. 08/322,694, Oct. 13, 1994, abandoned.

[51] Int. Cl.[6] ..... A41B 1/12; A41B 9/00; A41D 1/12

[52] U.S. Cl. ..... 2/69; 2/67; 2/78.2

[58] Field of Search ..... 2/70, 69, 78.1, 2/78.2, 78.4, 80, 83, 107, 96, 121, 128, 67

[56] References Cited

U.S. PATENT DOCUMENTS

| | | | |
|---|---|---|---|
| 729,785 | 6/1903 | McColl | 2/107 |
| 1,960,165 | 5/1934 | Ohinger | 2/128 X |
| 2,390,462 | 12/1945 | Rosenberg | 2/70 |
| 3,280,405 | 10/1966 | Fruhwirth | 2/107 |
| 5,343,564 | 9/1994 | Reynolds et al. | 2/70 |

FOREIGN PATENT DOCUMENTS

| | | | |
|---|---|---|---|
| 214406 | 4/1958 | Australia | 2/128 |
| 235546 | 5/1959 | Australia | 2/96 |
| 1217595 | 2/1959 | France | 2/128 |
| 961971 | 4/1957 | Germany | 2/128 |
| 2901252 | 7/1980 | Germany | 2/96 |
| 376075 | 5/1964 | Switzerland | 2/96 |
| 2889 | 7/1876 | United Kingdom | 2/128 |
| 548888 | 10/1942 | United Kingdom | 2/128 |

OTHER PUBLICATIONS

*Waterwear* catalog, vol. XIX (Fall 1997), pp. 1, 2, 10, 11.

*Primary Examiner*—John J. Calvert
*Assistant Examiner*—Shirra L. Jenkins
*Attorney, Agent, or Firm*—Maura K. Moran

[57] ABSTRACT

A unitary garment for full or partial coverage of a torso that may be fully put on or removed, at the choice of the wearer, as an assembled or a disassembled garment, and subsequently may be partially removed and put on, again at the choice of the wearer, has a torso portion for providing at least some coverage of the front and back of a wearer, a pants portion having a front portion, a crotch portion for passing between the legs and connected to the front portion, and a seat portion connected to the crotch portion. One of the seat portion and front portion is connected to the torso portion, and the other of the front portion and seat portion has at its edges first fastening elements to selectively attach and release to assemble and disassemble the garment. In another aspect of the invention, a unitary garment for full or partial coverage of a torso has a pants portion, for providing at least some coverage of the bottom half of a wearer, and a torso portion, for providing at least some coverage of the front and back of the top half of a wearer. One of the pants and the torso portions has an over band forming an inwardly facing ridge, the other of the portions has an under band forming an outwardly facing ridge, so that, when the one portion is disposed over the other portion, the bands interlock. Thus, the outwardly facing ridge is disposed between the inwardly facing ridge and the one portion, and the inwardly facing ridge is disposed between the outwardly facing ridge and the other piece to releasably attach the pants portion to the torso portion.

20 Claims, 8 Drawing Sheets

WHOLLY AND PARTIALLY REMOVABLE GARMENT

This application is a file-wrapper continuation-in-part of application Ser. No. 08/453,987, filed May 30, 1995, now abandoned, which is a divisional of application Ser. No. 322,694, filed on Oct. 13, 1994, now abandoned. This invention relates generally to clothing and particularly to unitary garments designed for full or partial coverage of the torso.

BACKGROUND OF THE INVENTION

Unitary garments such as women's bathing suits, exercise suits, and leotards, are popular because of their ease of wear and use, and for other reasons of style. They are often made of knit and elastic materials and are tight fitting. As a result, they can be difficult to put on and take off, especially when wet. In addition, every visit that a wearer makes to the bathroom requires a complete removal of the outfit, and subsequent re-dressing. This problem becomes more annoying when the outfit is worn, alone or under other clothing, for long periods of time or even all day, as happens frequently given the multiple, simultaneous uses to which such unitary garments are put by today's wearers. Such uses include cross-training (biking/hiking/swimming workouts) and all-day outings. A wearer does not want to keep getting dressed and re-dressed all day. Further, the changing and bathroom facilities in exercise-oriented venues, such as state parks and beaches, often are not sanitary, convenient or available. One solution that women have adopted has been to wear two piece outfits. However, by their nature, two piece outfits do not provide the full torso coverage and sleek, utilitarian lines of a one-piece garment.

Unitary garments are also useful in infant's and small children's clothing, where full torso coverage is preferred. Unfortunately, diapering and frequent bathroom visits, necessities with small children, are rendered difficult with unitary garments. Many one piece children's outfits have snaps at the crotch. However, snaps can be difficult to attach when the child is squirming. Also, snaps are rarely, if ever, found on an infant's or child's bathing suit.

One-piece bathing suits having removable portions to facilitate dressing and bathroom visits are well known in the prior art. However, none of the designs teach truly convenient or inconspicuous fastening mechanisms. For example, U.S. Pat. No. 5,083,316 (1992) to Ellen M. Kuehner, entitled Garment Structure, provides a decorative, interchangeable, removable crotch piece to effect ornamental definition while facilitating bodily functions. While the garment taught by Kuehner provides the sleek, stylish look of a unitary garment, it provides the attachment of the crotch piece at the pelvic bone, where attachment is somewhat inconvenient. Further, the garment described by Kuehner does not attempt to conceal the area of crotch access.

U.S. Pat. No. 2,857,600 (1958) to Gerald C. Finn, entitled Women's Bathing Suit, provides for concealed, releasable attachment of a crotch piece, inconveniently, again, at the pelvic bone at the front of a bathing suit. Finally, Finn also teaches auxiliary detachable securing of the crotch piece to the skirt or to an elongated restraining girdle band inside the front of the suit. These features render the garment design complicated, expensive to manufacture, and uncomfortable to wear.

One-piece suits consisting of a torso portion and a seat portion wrappable between the legs and fastenable about the body have been suggested, but none have taught both convenient and inconspicuous fastening mechanisms. U.S. Pat. No. 1,954,526 (1934) to E. Holahan, entitled Bathing Outfit, shows a suit consisting of a torso portion and a seat portion wrappable between the legs and held together at the hips with buttons and snaps and at the waist by a somewhat complicated arrangement. Side straps button at the waist in the back of the suit; then an extension of the seat portion, passed under the buttoned side straps, is buttoned onto the side straps; and, finally, the shoulder straps button over the seat extension onto the side straps. U.S. Pat. No. 2,060,689 (1936) to D. Read, entitled Bathing Suit, shows a wrap suit which uses front and back waist hook and eye closures. In use, a wearer wraps the suit between the legs, and hooks the seat portion to itself in the front under the suit (an awkward hand action), and then hooks tapered lateral projections in the back at the waist. It could not be completely assembled and subsequently put on and removed as a conventional unitary garment.

A number of wrap suits attach by ties. U.S. Pat. No. 2,567,442 (1951) to Alex Mitchell, entitled Bathing Garment, shows a suit secured to the body by ties at the neck, sides and waist. Ties also attach bathing suits in Design Pat. Nos. 138,422 (1944) (also to Alex Mitchell), 239,667 (1976) (to Eleanor Bouchard), and 249,096 (1978) (to Catalina Fowler). U.S. Pat. No. 2,412,502 (1946) to Bertice Garrison shows play suits that attach in the front and back with ties. Ties, while relatively simple and secure during sedentary use or light exercise, are lumpy to lie on, often require fussing to make them look right, occasionally tickle, and, during periods of heavy exercise, can come undone. Further, the bulkiness of knots take away from the sleek lines of a one-piece garment.

U.S. Pat. No. 2,561,783 (1951) to Marian Burr, is an undergarment (not intended for outerwear) designed for great snugness of fit and having a seat portion wrappable between the legs and fastenable with small hooks and eyes about the body to provide "give" in stress spots in a very tight-fitting garment. The garment is shown to have a complicated and expensive manufacture, being made of many pieces of fabric, some of which are cut straight with the cloth and others are cut on the bias to provide differential areas of support and stretch. Not intended to be made in today's active-wear materials, it could not be put on and removed as a conventional unitary garment.

Some designs suggest solving the above-described problems by creating a one-piece suit out of a two piece suit. U.S. Pat. No. 5,083,316 (1992), mentioned above, and U.S. Pat. No. 4,656,669 (1987) to Donna Beard, entitled Versatile Bathing Suit, both show a conventional two piece bathing suit apparently changed into a one piece suit by fastening an additional band of material onto the bra and panties of the two piece suit.

None of the above designs teach truly convenient, strong, secure, and inconspicuous fastening mechanisms.

It is an object of the invention to provide a garment with easy inconspicuous access to the crotch area while retaining the sleek, stylish look and easy functionality and operability of a one-piece garment.

It is a further object of the invention to provide a garment that is convenient and secure to wear, and easy and inexpensive to manufacture.

It is a further object of the invention to provide an infant and children's garment that is convenient to put on and remove.

It is a further object of the invention to provide a unitary garment arranged to be put on and removed, at the choice of the wearer, as an assembled or disassembled garment.

SUMMARY OF THE INVENTION

These and further objects are achieved by providing a unitary garment for full or partial coverage of a torso that may be fully put on or removed, at the choice of the wearer, as an assembled or a disassembled garment, and subsequently may be partially removed and put on, again at the choice of the wearer. The garment comprises a torso portion for providing at least some coverage of the front and back of a wearer, a pants portion having a front portion, a crotch portion for passing between the legs and connected to the front portion, and a seat portion connected to the crotch portion. One of the seat portion and front portion is connected to the torso portion, and the other of the front portion and seat portion has at its edges first fastening elements to selectively attach and release to assemble and disassemble the garment.

In one embodiment, the other portion selectively attaches to itself when it is wrapped between the legs and over the one portion, and the first fastening elements connect to themselves. In another embodiment, the seat portion releasably attaches to the front portion. The one portion has second fastening elements, near the connection of the torso portion and pants portion, to selectively attach and release from the first fastening elements on the other portion.

In one embodiment, the seat portion is connected to the torso portion, so the pants portion wraps from back to front. In another embodiment, the front portion is connected to the torso portion, so the pants portion wraps from front to back. In whatever direction the wrap occurs, the torso portion may have sufficient length or a shirt-tail at its bottom edge portion to be disposed underneath the pants portion for full bodily coverage.

The fastening elements may be located at about the hips of the unitary garment or may be positioned to attach the pants portion at about the waist of the wearer. They may be bra hook and loop combinations, ring and loop combinations, or clasps.

In other embodiments, the fastening elements are hidden by a full or partial skirt extending from the torso portion, or by at least part of a waist band portion extending at least part of the way around the waist of the unitary garment. In yet another embodiment, the torso portion is provided with a releasably attachable top torso portion, so that the unitary garment may be put on and removed under a wearer's clothing.

In accordance with a further aspect of the invention, a unitary garment for full or partial coverage of a torso has a pants portion, for providing at least some coverage of the bottom half of a wearer, and a torso portion, for providing at least some coverage of the front and back of the top half of a wearer. One of the pants and the torso portions function as an over-portion; the other one as a tucked portion. Each portion has a band attached thereto. When the over-portion is placed over the tucked portion, the bands fit snugly about the wearer, locking the portions together.

The over-portion has an over band attached along the circumference thereof. The over band has sufficient circumference to fit snugly about the wearer of the garment. It also has an over band face parallel to the over-portion and an over band inner edge extending between the over-portion and over band face. The tucked portion has an under band attached along the circumference thereof. The under band has an under band face parallel to the tucked portion and a tucked portion inner edge extending between the tucked portion and the tucked band face. The tucked portion inner edge and the under band face form an inwardly facing ridge extending to the tucked portion and disposed to contact the over band inner edge when the over-portion is placed over the tucked portion. When so disposed, the bands fit snugly about the wearer and the inner edges contact each other, the outwardly facing ridge locking the contact. The locking is sufficient to securely, snugly and releasably attach the garment around the circumference of the wearer.

In a further embodiment, the over band face and over band inner edge form an inwardly facing ridge extending parallel to the over-portion and disposed to contact the tucked portion inner edge when the over-portion is disposed over the tucked portion. When the over-portion is disposedover the tucked portion, the bands contact. The inwardly facing ridge contacts said outwardly facing ridge and the ridges interlock. Thus, the outwardly facing ridge is disposed between the inwardly facing ridge and the over-portion, and the inwardly facing ridge is disposed between the outwardly facing ridge and the tucked portion to releasably attach the pants portion to the torso portion. Preferably, the ridges are no more than about half the height of the bands.

In one embodiment, the over-portion is the pants portion, with the over band being a pants band forming a downwardly and inwardly facing ridge. The tucked portion is the torso portion having a torso edge portion for disposition within the pants portion. The under band is a torso band, disposed on the edge portion, forming an upwardly and outwardly facing ridge. When the torso portion is tucked into the pants portion, the bands interlock to releasably attach the pants portion to the torso portion.

In another embodiment, the over-portion is the torso portion, with the over band being a torso band forming an upwardly and inwardly facing ridge. The tucked portion is the pants portion arranged for disposition under the torso portion. The under band is a pants band, forming a downwardly and outwardly facing ridge. When the pants portion is disposed under the torso portion, the bands interlock to releasably attach the pants portion to the torso portion.

In another embodiment, a locking mechanism is provided for joining an over-portion and a tucked portion around a first circumference. The locking mechanism comprises an over band attached along the interior of the circumference of the over-portion. It has sufficient circumference to fit snugly about the first circumference and has an over band face parallel to the over-portion and an over band inner edge extending between the over-portion and over band face. The mechanism also has an under band attached along the exterior of the circumference of the tucked portion and an under band face parallel to the tucked portion and a tucked portion inner edge extending between the tucked portion and tucked band face. The tucked portion inner edge and under band face form an outwardly facing ridge extending parallel to the tucked portion and is disposed to contact the over band inner edge when the over-portion is stretched over the tucked portion. When the over-portion is disposed over the tucked portion, the bands fit snugly about a the first circumference and the inner edges contact each other, with the ridge locking the contact. The locking is sufficient to cause secure, snug and releasable attachment of the over-portion and tucked portion.

In a further aspect of the locking mechanism embodiment, the over band face and over band inner edge form an inwardly facing ridge attached thereto, and the under band has an outwardly facing ridge extending parallel to the over-portion and disposed to contact the tucked portion inner edge when the over-portion is disposed over said the portion. When the over-portion is disposed over the tucked portion, the bands fit snugly about the first circumference and contact. The inwardly facing ridge contacts the outwardly facing ridge and the ridges interlock to cause the outwardly facing ridge to be disposed between the inwardly facing ridge and the over-portion and the inwardly facing ridge to be disposed between the outwardly facing ridge and the tucked portion. The interlocking is sufficient to securely, snugly and releasably attach the over-portion and the tucked portion.

In a further aspect, there is provided a locking mechanism for joining a tucked portion to an over-portion about a first circumference, when the over portion has an over band attached along the interior of the circumference thereof, fits snugly about the first circumference, and has an over band face parallel to the over-portion and an over band inner edge extending between the over-portion and over band face. The mechanism comprises an under band attached along the exterior of the circumference of the tucked portion. The under band has an under band face parallel to said tucked portion and a tucked portion inner edge extending between the tucked portion and under band face. The tucked portion inner edge and under band face form an outwardly facing ridge extending parallel to said tucked portion and disposed to contact the over band inner edge when the over-portion is disposed over the tucked portion. The bands fit snugly about the first circumference and said inner edges contacting each other, said outwardly facing ridge locking said contact.

In yet another embodiment, the over-portion has an additional locking band positioned thereon abutting the over band, pressing against the tucked portion and pressing the tucked portion against the first circumference, whereby the releasable attachment is even further secured. The additional locking band may be exterior to the over band, pressing the over band against the tucked portion. It may also be inside the over-portion, entering and exiting the over-portion through a hole that extends through the elasticized over band.

In a further embodiment, there is provided a method of joining a first and second circumferential portion around a circumference, comprising attaching, to the interior of the first circumferential portion, a first band having a first band face parallel to the first circumferential portion and a first band inner edge extending between the first band face and the first circumferential portion. The first band is sized to fit snugly about the circumference. A second band is then attached to the exterior of the second circumferential portion. The second band has a second band face parallel to the second circumferential portion and a second band inner edge extending between the second band face and the second circumferential portion. The method then comprises forming from the second band face and second band inner edge an outwardly facing ridge extending parallel to the second circumferential portion and disposed to contact the first band inner edge when the over-portion is disposed over the tucked portion. The first portion is then placed over the second portion, so that the portions fit snugly about the circumference and the bands contact, with the first band inner edges and the outwardly facing ridge contacting each other. The ridge locks the contact, the contact being sufficient to securely, snugly and releasably attach the first portion to the second portion.

In another aspect, the method further comprising the step of forming from the first band face and first band inner edge an inwardly facing ridge on the first band, the inwardly facing ridge extending parallel to the first circumferential portion and disposed to contact the second band inner edge when the over-portion is disposed over said tucked portion. When said bands contacts, the inwardly facing ridge contacts the outwardly facing ridge and the ridges interlock, with the outwardly facing ridge disposed between the inwardly facing ridge and the first portion and the inwardly facing ridge disposed between the outwardly facing ridge and the second portion. In another embodiment, the method further comprises attaching an additional locking band to the first circumferential portion and tightening the additional locking band to press the first circumferential portion against the second circumferential portion. The second circumferential portion is thus pressed tightly against the circumference, to even further secure a releasable attachment.

The first circumference may be the body of a wearer, with the first circumferential portion an over portion, and the second circumferential portion a tucked portion. The first band may be a over band, and the second band an under band. The bands may be positioned to be disposed about the waist, hips, or chest of a wearer of the garment. They may be formed of a rigid or semi-rigid material or of thick elastic. At least one of them may have a selectively sized circumference, to be changed by the wearer. Preferably, the ridges are no more than about half the height of the bands. In addition, the ridges may have approximately the same height, or the outwardly facing ridge may be significantly deeper than the inwardly facing ridge. In yet further embodiments, the garment is formed of material that stretches in at least two different directions.

BRIEF DESCRIPTION OF THE DRAWINGS

The above-mentioned and other features of the invention will become more apparent by reference to the following description taken in connection with the accompanying drawings in which.

DESCRIPTION OF THE PREFERRED EMBODIMENTS

Figure 1A:
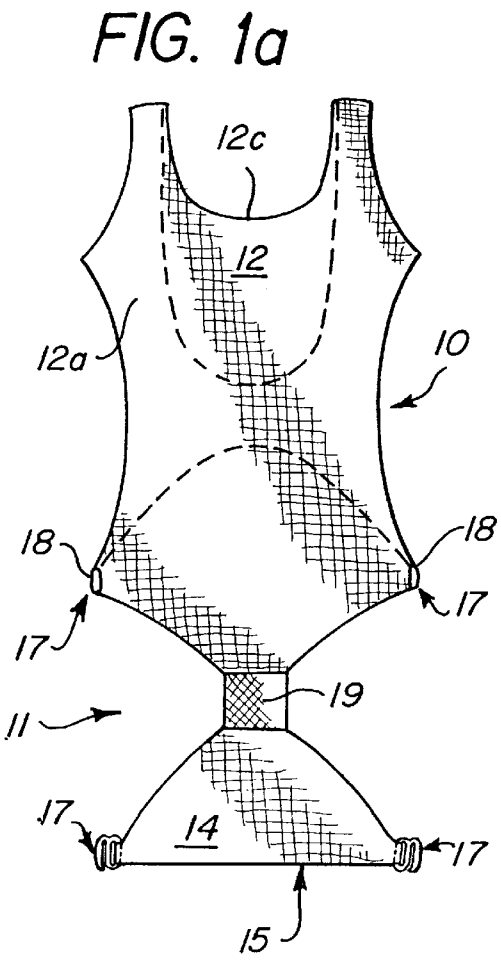
FIG. 1*a* is a front perspective view of a first embodiment of the present invention, showing a disassembled suit.

FIG. 1*a* shows the front of a bathing suit 10 having a torso portion 12 and a seat portion 14. The rear of the suit 10 may be seen as a dashed line in FIG. 1*a*, and the front of the suit 10 may be seen as a dashed line in FIG. 1*b*. The suit 10 is shown disassembled, as in prior to use, with the pants portion 11, when secured in place, serving to define a bathing suit's usual leg openings and seat in the bottom of the suit 10. The suit 10 is formed from a few simple separate pieces of material, providing economy of pattern layout and easy manufacturing. For example, the suit 10 may be made of three pieces of material, a front torso portion 12*a,* a rear torso portion 12*b,* and a seat portion 14, cut straight on a length of material having a horizontal, or width-wise stretch, so that the suit, when sewn together to form the suit 10, will have stretch in at least the horizontal direction and thus allow it to be form fitting and put on over the hips or shoulders. As seen in FIG. 1*a,* the suit 10 may also have a crotch piece 19 made of cotton or other breathable material, or a breathable liner, not shown, added to increase the comfort of the wearer. The rest of the suit 10 may be made of cotton or of nylon lycra, a material frequently used in bathing suits for its ease of drying and its stretchiness.

The left and right hips of the torso portion 12 and the left and right ends of the forward edge 15 of the seat portion 14 is provided with fastening elements 17. The fastening elements 17 may be any kind of fasteners, including but not limited to hook and pile means, commonly known as "VELCRO", available from VELCRO USA INC., of Manchester, N.H., or any kind of clasps or buckles. In the current embodiment, the elements 17 are swim bra hooks 16, sewn onto the ends of the top edge 15 of the seat portion 14, and loops 18, located on the hips of torso portion 12. Each hook 16 has a slot 13 for receiving an edge of material to create a self loop from the material when it is drawn through the slot 13, lapped over and sewn down. The hooks 16 used in the current embodiment are Swim Suit Bra Hooks (¾ inch size) available from Dritz Corporation of Spartansburg, S.C.

Figure 1B:
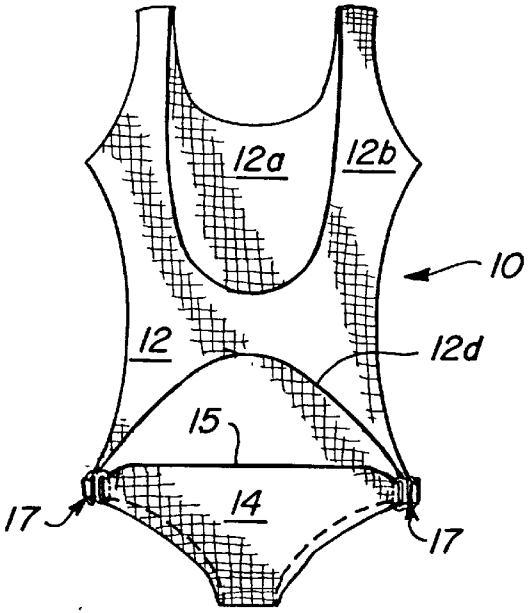
FIG. 1*b* is a rear perspective view of the embodiment of FIG. 1*a,* showing the suit as in use with the seat portion wrapped from front to back between the legs and attached to the torso portion at the hips.
Figure 1C:
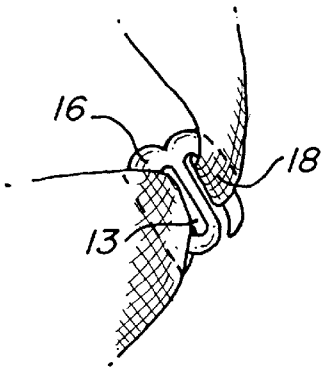
FIG. 1*c* is an enlarged view of the locking mechanism shown in FIG. 1.
Figure 1D:
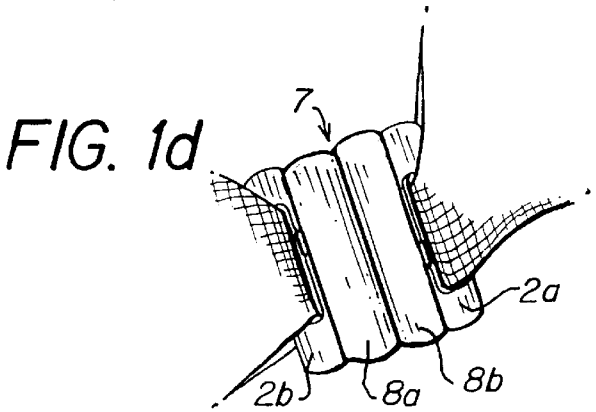
FIG. 1*d* is an enlarged view of an alternative locking mechanism for the embodiment shown in FIG. 1.
Figure 1E:
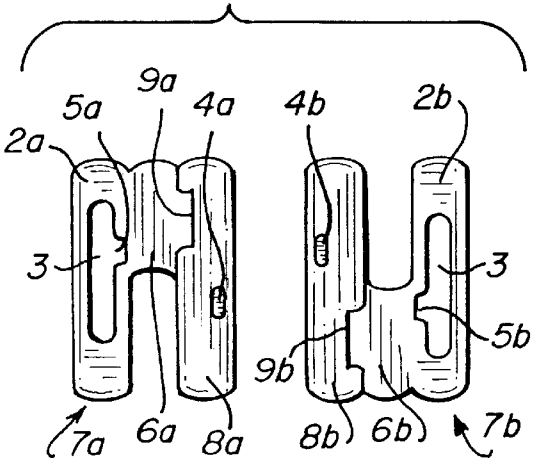
FIG. 1*e* is an enlarged view of the locking mechanism shown in FIG. 1*d,* now shown disassembled.

In other embodiments, it may be preferable to provide a cooperative clasp combination of the sort shown in FIG. 1*d* and 1*e*. The clasp 7, being 2¼" in height and 1½" in length, is a very flat, very secure clasp formed of two parts, a right member 7*a* and a left member 7*b,* each with a flat edge portion 2*a,* 2*b* having a slot 3, for receiving an edge of material and creating a self loop, and a flat receiving portion 6*a,* 6*b* that is essentially planar with the flat edge portion 2*a,* 2*b*. Each member 7*a,* 7*b* also has a flat raised portion 8*a,* 8*b* in a plane parallel to but above the plane containing the portions 2*a,* 2*b,* 6*a,* and 6*b*. The offset between the planes is essentially the thickness of the portions 8*a* and 8*b*. The portion 6*a* extends across the upper half of the member 7*a,* and the portion 6*b* extends across the lower half of the member 7*b*. At the juncture between the portions 6*a,* 6*b* and 8*a,* 8*b* are the ridges 9*a,* 9*b,* planar with portions 6*a,* 6*b*. Each flat edge portion 2*a,* 2*b* has an indentation 5*a,* 5*b* in the slot 3, and each raised portion 8*a,* 8*b* has a bar 4*a,* 4*b* extending downwardly therefrom, with the bar 4*a,* 4*b* arranged to fit into the indentation 5*b,* 5*a* respectively when the clasp 7 is closed. The flat receiving portions 6*a,* 6*b* are sized and arranged to receive and hold the raised portions 8*b,* 8*a*. When the portions 8*b,* 8*a,* slip into the receiving portions 6*a,* 6*b,* the ridges 9*a,* 9*b,* operate as a hinge to facilitate the clipping together of the portions 6*a,* 6*b,* 8*a,* 8*b,* with the bar 4*a,* 4*b* locking the clasp 7 by slipping into the indentation 5*b,* 5*a* respectively. The clasp 7 is available from Windsor Button Shop, of Newton, Mass. as Part No. R876.

In other embodiments, it may be preferable to provide even larger hooks, for easier clasping and aesthetic reasons. The fastening elements may be smaller in size or different in design. For example, a circle or ring having an gap or a latch to receive a loop, or a sealed circle or ring to receive a loop releasable with VELCRO fasteners, might be attractive.

The invention in operation is shown in FIGS. 1*b* and 1*c*. In use, the suit 10 may be put on in two different ways. A user may join the hooks 16 and loops 18, thus attaching the seat portion 14 to the torso portion 12 at the hips to secure the pants portion 11 to completely form the suit 10, and then put on the suit 10 like a regular tank-style bathing suit, legs first. Given that the material with which the suit 10 is made can stretch in at least the width-wise direction, the suit 10 may be slipped up and over the hips and fit snugly about the body of the wearer. Alternatively, the user could slip the suit on over her head, then wrap the seat portion 14 between her legs from front to back, and attach the torso portion 12 to seat portion 14 by slipping the hooks 16 into the loops 18. During a visit to the bathroom, a user may completely undress, or she may unhook the hooks 16 from the loops 18 and unwrap the seat portion 14 from back to front. For convenience, when using the toilet, the wearer who has partially removed the suit 10 may hang the seat portion 14 from the front neck opening 12*c* of the torso portion 12. After the bathroom visit, the user simply re-wraps the seat portion 14 between the legs from front to back, and re-attaches the hooks 16 into the loops 18. Also, the hooks 16 may be released momentarily in the ocean to dislodge sand from the pants portion 11.

Figure 2B:
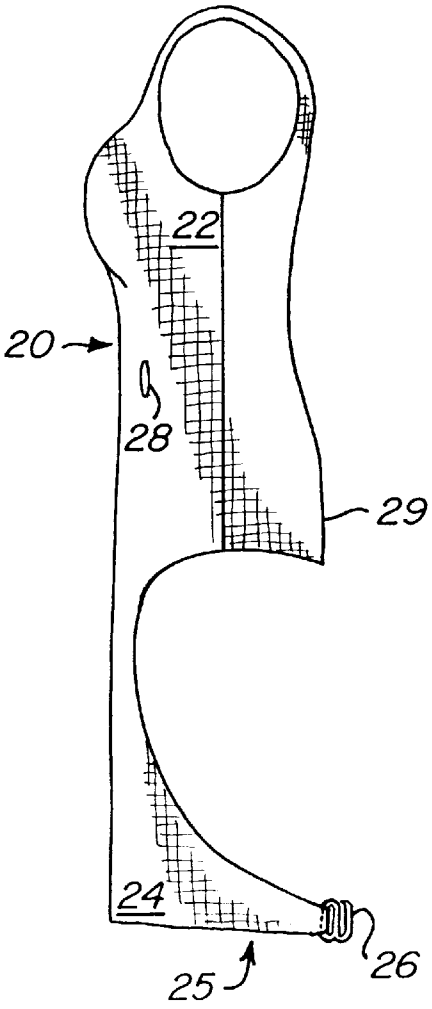
FIG. 2*b* is a side perspective view of the embodiment of FIG. 2*a,* showing the suit disassembled.
Figure 2A:
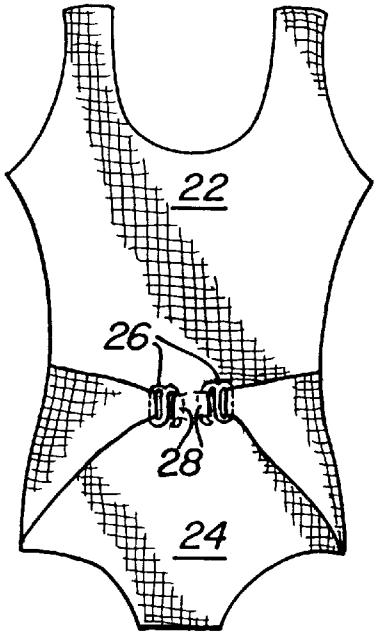
FIG. 2*a* is a front perspective view of a second embodiment, showing the seat portion wrappable from front to back and attached to the torso portion at the waist.

FIGS. 2*a* and 2*b* show a second embodiment of the invention, in which a suit 20 has a torso portion 22, with loops 28 sewn into the torso portion 22 at the waist, and a seat portion 24, with hooks 26 on the left and right ends of the forward edge 25 of the seat portion 24. The suit 20 is formed into a unitary garment by wrapping the seat portion 24 between a person's legs from front to back and releasably attaching the hooks 26 into loops 28. FIG. 2*b* shows the torso portion 22 provided with a deep tank top bottom portion 29 arranged to cover at least a portion of a wearer's hips. In use, the tank top bottom portion 29 lies underneath the seat portion 24 so as to ensure complete coverage of a user's back. In lieu of a tank top bottom portion 29, the suit 20 may have a deep rectangular shaped shirt-tail, not shown, for tucking into the seat portion 24.

Figure 3B:
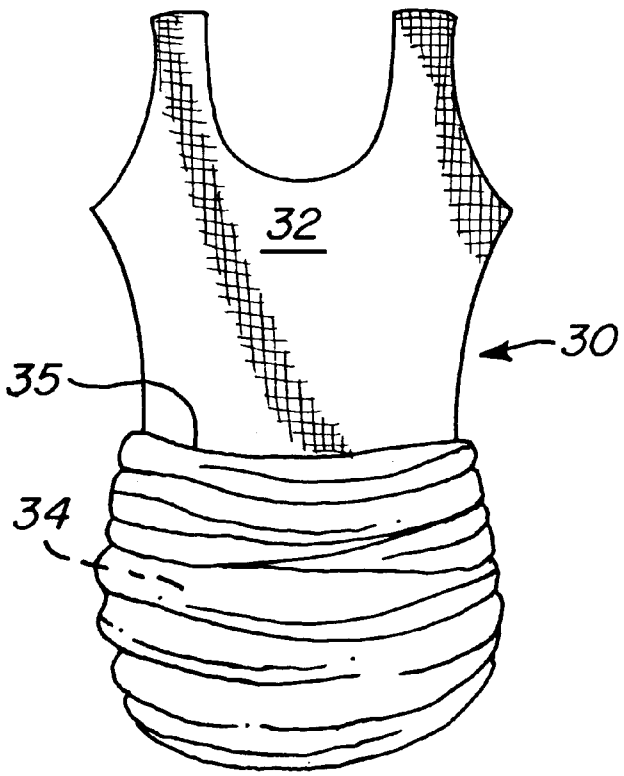
FIG. 3*b* is a rear perspective view of the embodiment of FIG. 3*a;*
Figure 3A:
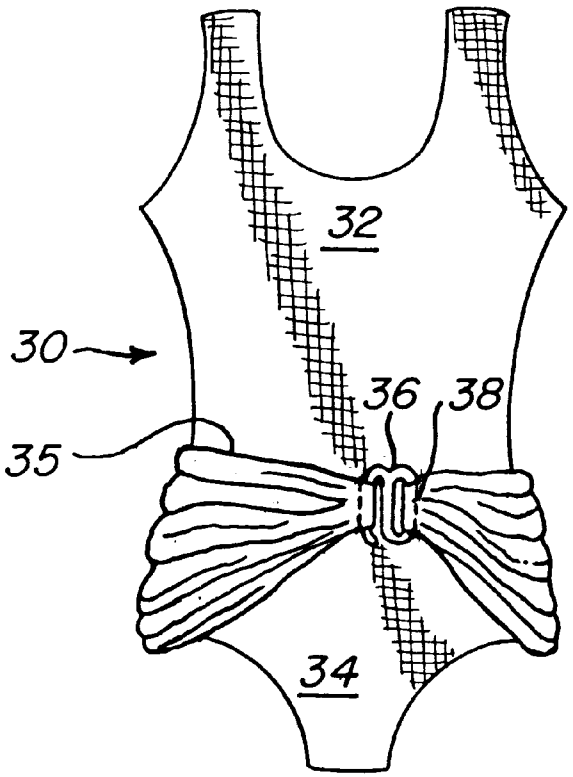
FIG. 3*a* is a front perspective view of a third embodiment, showing a shirred seat portion wrappable from front to back between the legs and attached to itself at the waist.

FIGS. 3*a* and 3*b* show a third embodiment of the invention, in which a suit 30 has a torso portion 32 and a seat portion 34, with a hook 36 and a loop 38 sewn into the left and right ends of the forward edge 35 of the seat portion 34. The unitary garment is again formed by wrapping the seat portion 34 between a person's legs from front to back. In the current embodiment, however, the seat portion 34 releasably attaches to itself (using the hook 36 and the loop 38) and not to the torso portion 32. Again, the torso portion 32 is provided with a deep tank top bottom portion, not shown, in the back of the suit 30 which, in use, lies underneath the seat portion 34 so as to ensure complete coverage of a user's back. The suit 30 is shown having optional shirring in the seat portion 34. It may also be desirable to have seat portion made of material of contrasting color.

Figure 4B:
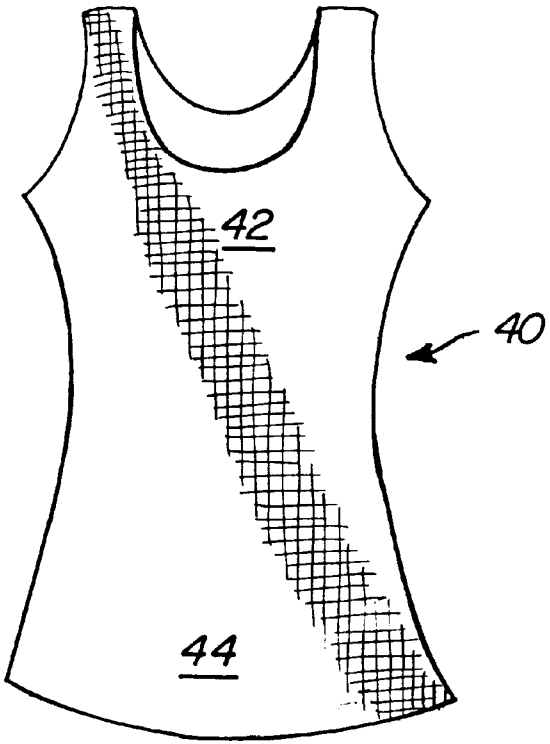
FIG. 4*b* is a rear perspective view of the embodiment of FIG. 4*a,* showing the suit assembled.
Figure 4A:
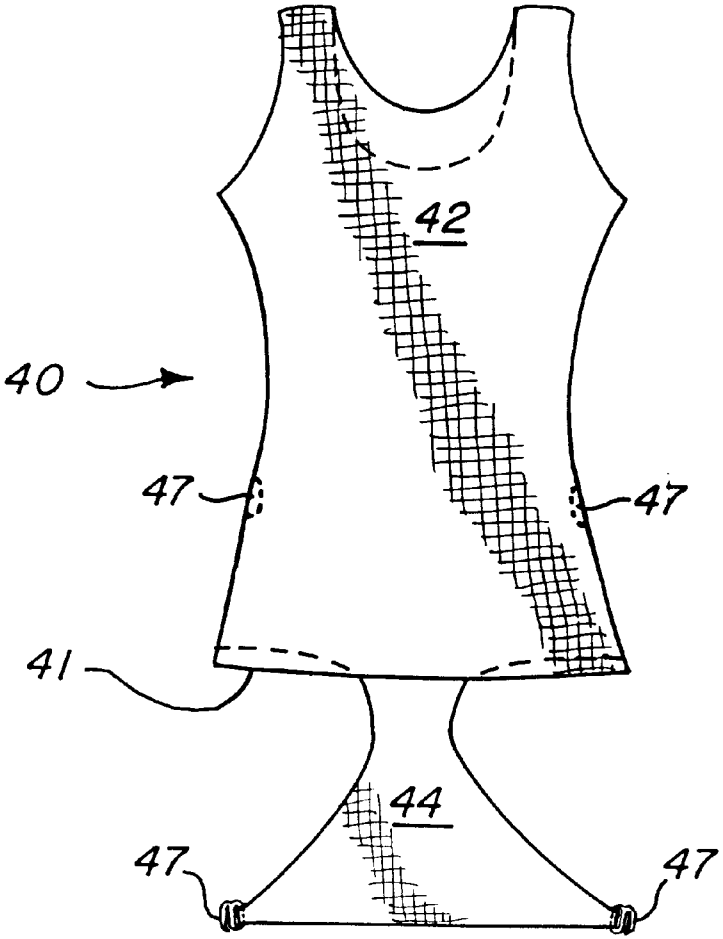
FIG. 4*a* is a front perspective view of a fourth embodiment, showing a disassembled suit having a seat portion wrappable from back to front and attachable to the torso portion at the hips.

FIGS. 4*a* and 4*b* show a fourth embodiment of the invention, in which a suit 40 is formed into a unitary garment by wrapping a pants portion 44 between a person's legs from back to front and releasably attaching the seat portion 44 to the torso portion 42 using fastening elements 47 under a short skirt 41 located in the front of the torso portion 42. The skirt 41, found only on the front of the suit 40, is an extension of the torso portion 42, similar to a long tank top extending at least partially over a wearer's hips. The fastening elements 47 are sewn onto the edges of the pants portion 44, and on the inside of the suit 40 at its side seams, not shown, between the hips and the waist. Further, as shown in FIG. 4*b*, the rear of the suit has no ornamentation, and so appears to be in the style of a conventional simple tank-style bathing suit. Alternatively, the skirt 41 may be an extra piece of material, gathered or flared, sewn all the way around the front and back of the torso portion 42. A belt or waist band portion, not shown, might be provided to camouflage the stitching that joins the skirt 41 to the suit 40. Alternatively, the suit 40 may be designed to have its torso portion 42 long enough to constitute a minidress, not shown, and its pants portion 44 sewn onto the torso portion on the inside of the front of the torso portion, so that the pants portion wraps between the legs from front to back and attaches to itself at the hips. A belt or waist band portion may be provided to camouflage the stitching that joins the pants portion to the suit 40.

Figure 5:
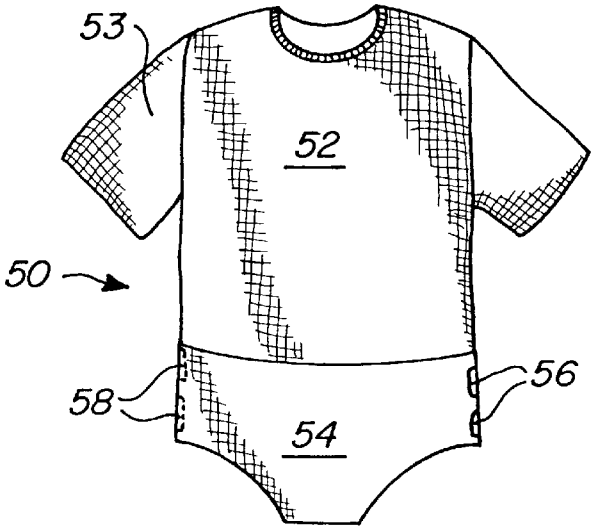
FIG. 5 is a front perspective view of a fifth embodiment, showing a children's suit.

The style of the torso of the above-described suits may vary greatly. For example, the top portion of the torso portion may have different armhole cuts and neck closures. A suit may be strapless, or have thin straps or sleeves. For example, FIG. 5 shows a child's outfit, particularly adapted for ease of diapering, in which a suit 50, having sleeves 53 attached to a torso portion 52, is formed into a unitary garment by wrapping the pants portion 54 between a child's legs from back to front and releasably attaching the pants portion 54 to the torso portion 52 using two pairs of hooks 56 and loops 58 at the waist and hips of the suit 50. A full or partial belt or band of decorative material, not shown, may be provided to conceal some or all of the hooking mechanism.

Figure 7:
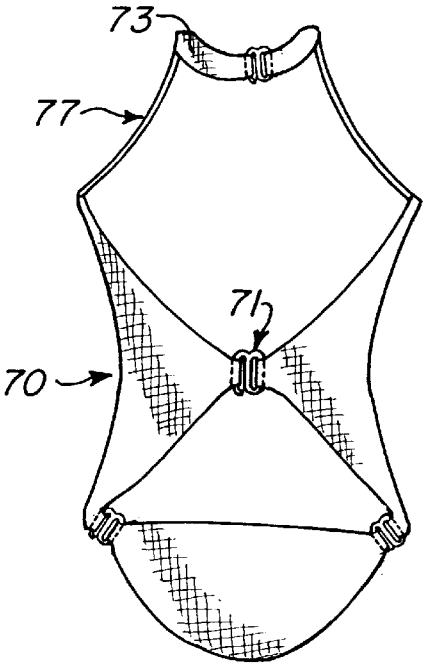
FIG. 7 is a rear perspective view of a seventh embodiment, showing an alternative torso portion.
Figure 6:
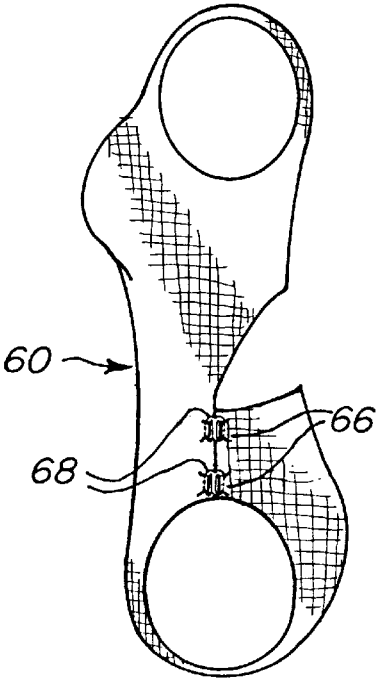
FIG. 6 is a side perspective view of a sixth embodiment, showing an alternative locking mechanism and pants portion.

FIGS. 6 and 7 show alternative embodiments of the invention to demonstrate further that the style of the suit may vary. For example, a waist band portion may extend at least part of the way around the garment to hide the fastening elements underneath the waist band portion. Further, as shown in the torso portion 12 of FIG. 1*b*, some of a wearer's back may be left exposed between seat portion 14 and torso portion 12 for stylistic reasons. The top edge 15 of the seat portion 14 is cut straight across, and the bottom back edge 12*d* of the torso portion 12 is cut high so that when hooks 16 and loops 18 are fastened, a bikini bottom is formed. FIG. 6 shows an embodiment with a full, non-bikini seat, in which a pair of hooks 66 and loops 68 are provided at each hip of a suit 60 in order to provide more skin coverage at the hip and rear end. FIG. 7 shows an alternative torso arrangement. A suit 70 has a releasably attachable halter 73 and a bra hook 71 that forms a releasable top torso portion 77. The embodiment in FIG. 7 is particularly useful, in that the releasable top portion 77 easily allows the wearer to put on and remove the suit 70 under clothing.

Figure 9:
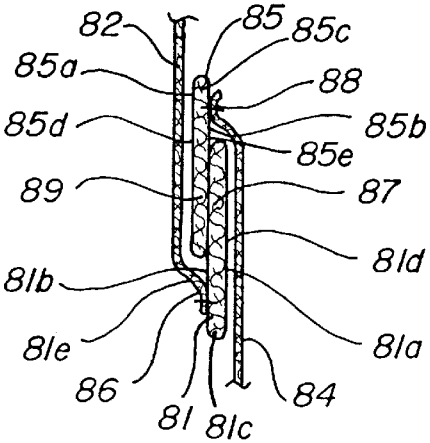
FIG. 9 is an enlarged view of the locking mechanism shown in FIG. 8.
Figure 8:
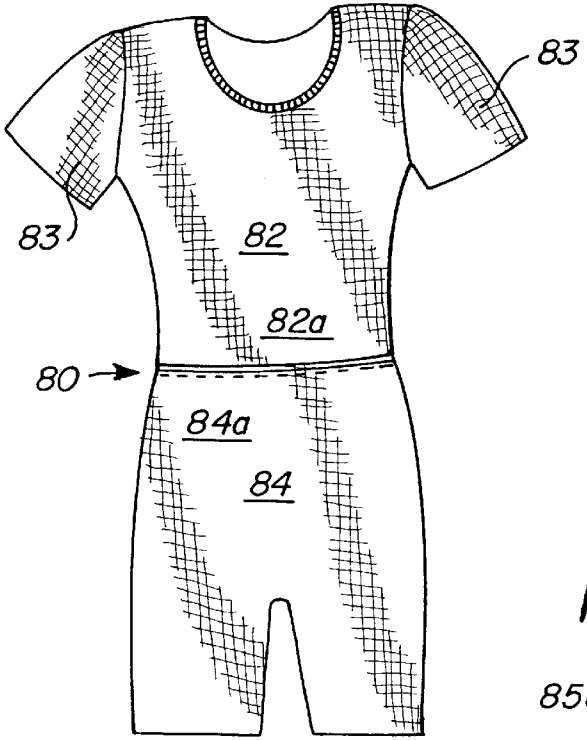
FIG. 8 is a front perspective view of an eighth embodiment, showing fully detachable torso and pants portions linked together to form a unitary garment.

FIG. 8 shows an alternative embodiment of the current invention, in which a torso portion 82, having sleeves 83, and a fully separate pants portion 84 are linked together at the waist to form a one piece suit 80. The pants portion 84 comprises a first circumferential portion 84*a* and the torso portion 82 comprises a second circumferential portion 82*a*. As seen in FIG. 9, which is shown out of scale for emphasis, the torso portion 82 has a torso under band 81, which comprises a second band 81*c*, of ½ inch wide elastic sewn onto the bottom hem 86 of the torso portion 82. The torso under band 81 has an under band face 81*a*, which comprises a second band face 81*d*, parallel to the torso portion 82, and a tucked portion inner edge 81*b*, which comprises a second band inner edge 81*e*, extending between the torso portion 82 and the under band face 81*a*. The tucked portion inner edge 81*b* and under band face 81*a* form an upwardly and outwardly facing ridge 87 of approximately ⅛ inches height, extending parallel to the torso portion 82. Similarly, the pants portion 84 has a pants over band 85, which comprises a first band 85*c*, of ¾ inch wide elastic sewn in a gathering manner onto the top hem 88 of the waist of the pants portion 84

The pants over band 85 has an over band face 85*a*, which comprises a first band face 85*d*, parallel to the pants portion 84, and an over band inner edge 85*b*, which comprises a first band inner edge 85*e*, extending between the pants portion 84 and the over band face 85*a*. The over portion inner edge 85*b* and over band face 85*a* form a downwardly and inwardly facing ridge 89 of approximately ⅛ to ¼ inches height extending parallel to the pants portion 84. When the pants portion 84, functioning as an over-portion, is disposed over the torso portion 82, functioning as a tucked portion, the outwardly facing ridge 87 is disposed to contact the over band inner edge 85*b*, and the inwardly facing ridge 89 is disposed to contact the tucked portion inner edge 81*b*.

It is not necessary for the proper working of the current invention for the bands 81, 85 to be disposed about the waist of the garment 80. Wherever positioned, the pants over band 85 should have sufficient circumference to fit snugly about the wearer of the garment 80. While the torso under band 81 may be sewn on to provide some gathering of the material, in the current embodiment it is sewn straight, in a manner to achieve no material gathering. Preferably the circumference of the pants over band 85 is equal to or less than the circumference of the torso under band 81.

In use, when the torso portion 82 is tucked into the pants portion 84 and the pants over band 85 is positioned around the torso portion 82 slightly above the torso under band 81 and the bands 81, 85 fit snugly about the wearer, the pants over band 85 slightly slides down and the torso under band 81 slightly slides up. The inner edges 81*b*, 85*b* contact each other, and the outwardly facing ridge 87 locks the contact. The bands 81, 85 interlock, with the ridge 87 disposed between the ridge 89 and the pants portion 84 and the ridge 89 disposed between the ridge 87 and the torso portion 82, to form a unitary garment 80.

Figure 10:
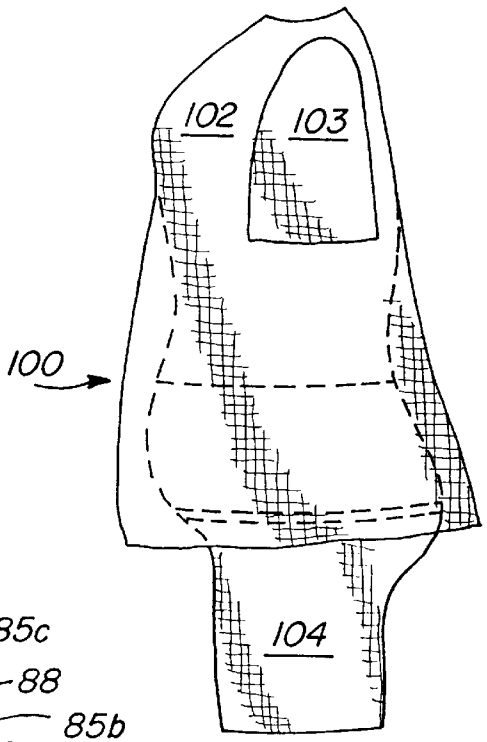
FIG. 10 is a side perspective view of an ninth embodiment, showing fully detachable torso and seat portions linked together to form a unitary garment, with the contours of a wearer's body and aspects of the pants portion, normally hidden by the torso portion, shown in dashed lines.
Figure 11:
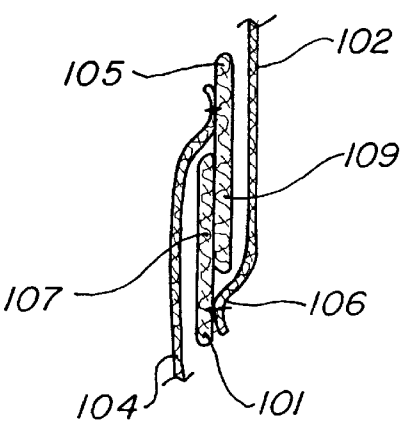
FIG. 11 is an enlarged view of the locking mechanism shown in FIG. 10.

FIG. 10 shows another embodiment of the current invention, in which a torso portion 102, having sleeves 103, and a fully separate pants portion 104 are linked together to form a one piece maternity garment 100. Although it is not necessary for the proper working of the current invention in a non-maternity context, the torso portion 102 is blousy, that is, not form-fitting. As seen in FIG. 11, the torso portion 102 has a torso over band 101 of ½ inch wide elastic sewn in a gathering manner onto the bottom hem 106 of the torso portion 102 to form an upwardly and inwardly facing ridge 107 of approximately ⅛ inches height. Similarly, the pants portion 104 has a pants under band 105 of ¾ inch wide elastic sewn in a gathering manner onto the hips of the pants portion 104 to form a downwardly and outwardly facing ridge 109 of approximately ⅛ to ¼ inches height.

The torso over band 101 has sufficient circumference to fit snugly about the wearer of the garment 100. The pants portion 104 has a fastening mechanism, not shown, at the waist to hold the pants portion 104 up on the body of the wearer. While the pants under band 105 may be sewn on to provide some gathering of the material, in the current embodiment it is sewn straight, in a manner to achieve no material gathering. Preferably, the circumference of the torso over band 101 is equal to or less than the circumference of the pants under band 105.

In use, when the torso portion 102 is disposed over the pants portion 104 and the torso over band 101 is positioned around the pants portion 104 slightly below the pants under band 105, the pants under band 105 slightly slides down and the torso over band 101 slightly slides up. The bands 101, 105 interlock, with the ridge 107 disposed between the ridge 109 and the pants portion 104 and the ridge 109 disposed between the ridge 107 and the torso portion 102, to form a unitary garment 100.

The invention shown in the embodiment of FIG. 10, with the bands 101, 105 positioned to be disposed about the hips of the wearer, is particularly useful in maternity wear. The interlocking of the bands 101, 105 prevents the torso portion 104 from riding up on the hips of the wearer.

Figure 12B:
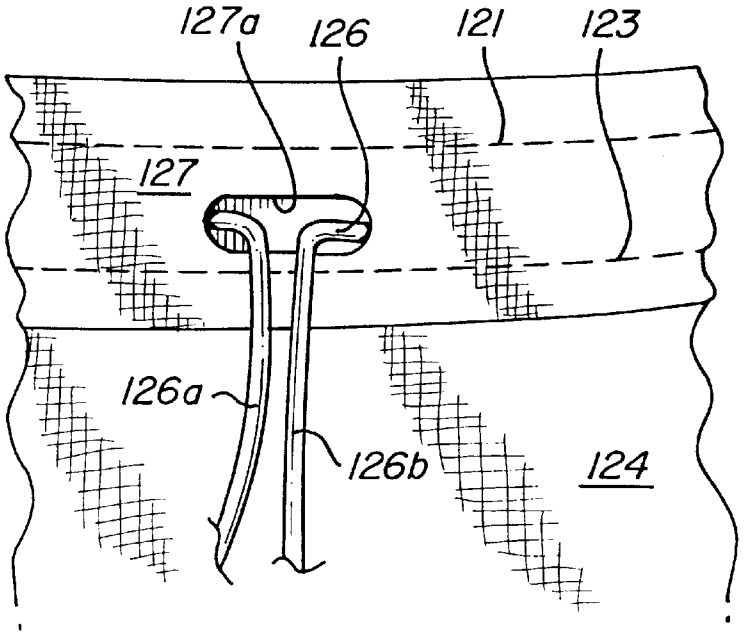
FIG. 12*b* is a rear view of the inside of the pants portion having the locking mechanism shown in FIG. 12*a;*
Figure 12A:
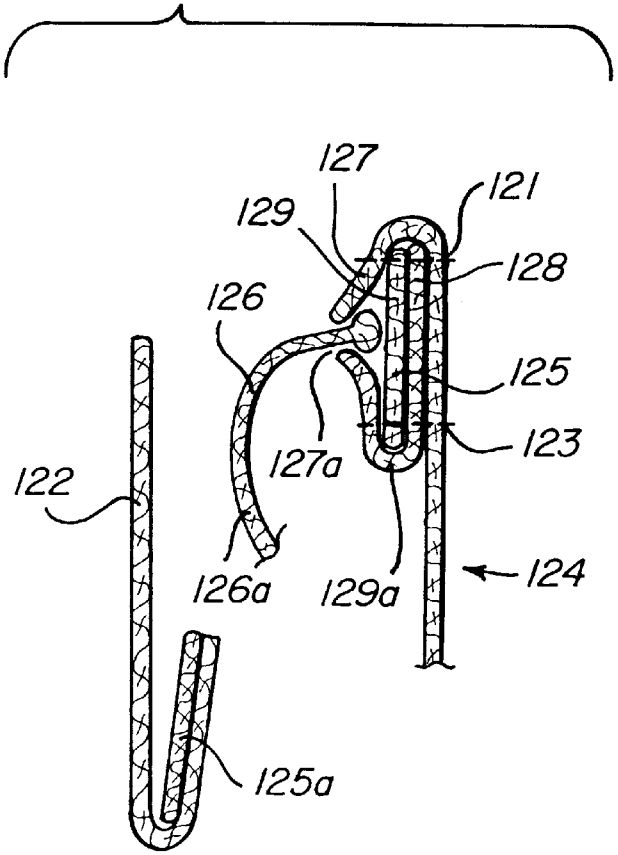
FIG. 12*a* is a side cut-away view of an alternative locking mechanism, showing a drawstring added to the inside of a pants portion.

It is occasionally desirable to provide even more secure attachment of an over-portion and a tucked portion. FIGS. 12*a, b* show a pants portion 124, having an interior elastic pants over band 125 that forms a downwardly and inwardly facing ridge 129*a*. The top edge 128 of the waist of the pants portion 124 is sewn with a zigzag stitch to the elastic 129. The edge 128 and elastic 129 are folded to the inside of the pants portion 124 (so that the elastic is inside the material of the pants portion 124) to form the band 125. The seams 121, 123 are then sewn into the band 125 parallel but spaced apart to form a casing 127.

The pants portion 124 has a hole 127*a* on the interior of the band 125 through which a drawstring 126 may enter and exit the casing 127. The drawstring 126 is run through the casing 127 between the elastic 129 and the inwardly-facing material of the pants portion 124.

In use, the pants portion 124 is positioned over a torso portion 122 above a torso under band 125*a*. The drawstring 126 is tightened and tied, and its ends 126*a*, 126*b* are tucked into the pants portion 124, behind the band 125 and over the band 125*a*. Interlocking occurs between the portions 124, 122 in the manner described above for suits 80 and 100. The drawstring ends 126*a*, 126*b* cause a small gap to form in the interlocking, but the gap is insufficient in size to pull the portions 122, 124 apart. The tightened drawstring 126 in the casing 127 presses the pants portion 124 against the torso portion 122, and the torso portion 122 against the skin of the wearer. Thus, the attachment of the two portions 122, 124 is made even more secure.

It is not necessary that the bands 81, 85 and 101, 105 be made of elastic; they could be made of any rigid or semi-rigid material that could be buckled or tied into place to provide the circumferential snugness necessary for the ridges 87, 89 and 107, 109 to interlock. Adjustable buckling or tying may be particularly useful in maternity clothes, where selective circumferential sizing through loosening of the bands may be useful as the pregnancy progresses and the hips widen. Elastic is the material of choice when stretching about the body is preferred to facilitate dressing and undressing. When the bands 81, 85 and 101, 105 are formed of elastic, it is preferred that the elastic be thick, have a no-roll composition, or be made of a large proportion of polyester so that the ridges so formed have sufficient rigidity. Further, the bands, of whatever material, and ridges may be of different widths than the above-described.

Figure 14:
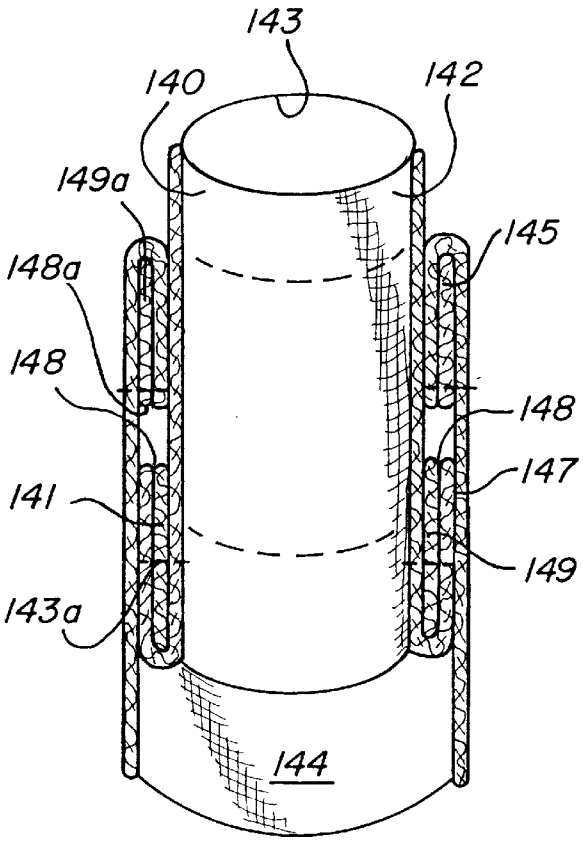
FIG. 14 is an inside cut-away view of an assembled over-portion and tucked portion having another locking mechanism for joining them around a first circumference.

Generally, deep ridges are preferable because they provide a secure interlocking. Deep ridges make it more difficult for the bands 81, 85 to come apart. However, it is preferable that the ridges 87, 89 be no more than about half the height of the bands from which they are formed. Nevertheless it is not necessary for the working of the invention for both bands to have deep ridges. One or both of the bands may have very short ridges. FIG. 14 shows the joining of an over-portion and a tucked portion around a first circumference 143, in which the outwardly facing ridge is significantly deeper than the inwardly facing ridge.

The garment 140 has a torso portion 142, which functions as a tucked portion, tucked into a pants portion 144, which functions as an over-portion. The torso portion 142 has elastic 149 sewn with a zigzag stitch to the outside of its bottom edge 148. The edge 148 and elastic 149 are folded up and sewn to the outside of the torso portion 142 (so that the elastic is inside the material of the torso portion 142) to form the band 141 attached along the circumference of the tucked portion. A seam 143*a* is then sewn into the portion 142 through the elastic 149 at about the middle of the height of the elastic 149 to provide the band 141 with an outwardly facing ridge 147 no deeper than about half of the height of the band 141.

The pants portion 144 has relatively thick, rigid elastic 149*a* sewn with a zigzag stitch to the inside close to its top edge 148*a*. The edge 148*a* and elastic 149*a* are folded to the inside of the pants portion 144 (so that the elastic is inside the material of the pants portion 144) and sewn through at about the zigzagging to form the band 145 attached along the circumference of the pants portion 144 and having sufficient size to fit snugly about the first circumference 143.

In use, when the pants portion 144 is stretched into place over the torso portion 142, the outwardly facing ridge 147 contacts the over band 145. The ridge 147 is caught below the pants over band 145 at the inner edge 147*a,* to result in a locking of the portions 142, 144 to form a unitary garment 140. Thus, the contact is sufficient to cause a secure, snug and releasable attachment of the portions 142, 144. A thick, rigid elastic in the pants portion 144 is preferred to accomplish the secure attachment. However, if relatively thick, rigid elastic is not desirable, a supplemental locking mechanism, such as an additional locking band may be used to ensure secure attachment.

Figure 13:
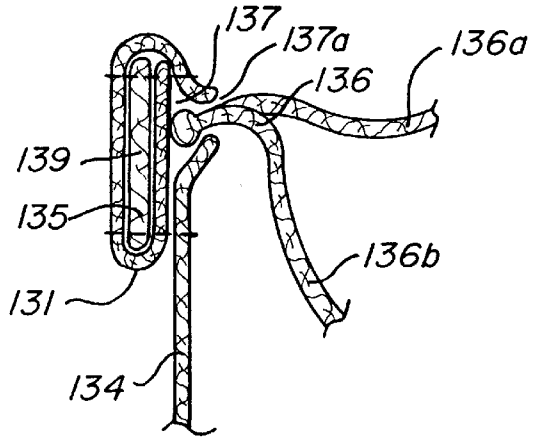
FIG. 13 is a side cut-away view of another alternative locking mechanism, showing a drawstring extending from the outside of a pants portion.

Additional locking bands for over-portions with relatively shallow ridges are shown in FIGS. 13, 15, 16, and 17. FIG. 13 shows a drawstring 136 run through a casing 137 in a pants portion 134 having a band 131 formed by elastic 139 and the twice folded-over material of the pants portion 134. In FIG. 13, the drawstring 136 enters a casing 137 through a hole 137*a* on the exterior of a pants portion 134. The drawstring exit could also have been an interior hole, such as the one shown in FIG. 12*b*. The drawstring 136 of FIG. 13 operates in the same manner as the drawstring 126 of FIGS. 12*a* and 12*b;* but it is easier to use because the tying occurs on the exterior. In addition, the ends 136*a,* 136*b* require no tucking. Further, by placing the drawstring 136 exterior to the band 131 when it is tightened, the drawstring 136 presses the over band 131 against the tucked portion, not shown, thus securing the attachment even further.

Figure 15:
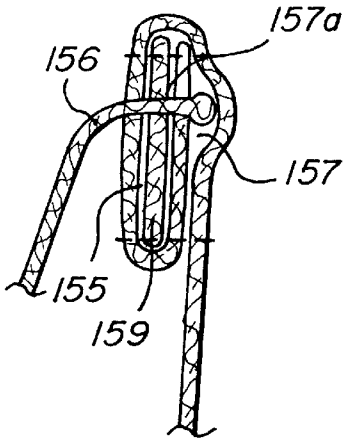
FIG. 15 is a side cut-away view of another alternative locking mechanism, showing a drawstring drawn through the elastic to the interior of the pants portion.
Figure 16:
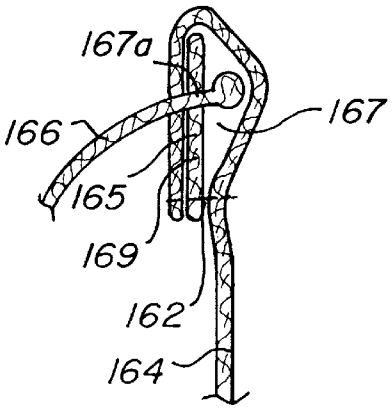
FIG. 16 is a side cut-away view of another locking mechanism, showing the material of the pants portion wrapped only once around the elastic.

In FIGS. 15 and 16, the drawstrings 156, 166, respectively, enter casings 157, 167 through holes 157*a* and 167*a* that extend entirely though the folded material and elastic 159, 169 that form bands 155, 165. FIG. 16 differs from FIG. 15 in two ways: first, the band 165 is formed by folding the material of the pants portion 164 only once over the elastic 169, and second, the casing 167 is formed with only one line of stitching 162, sewn through the band 165.

Figure 17:
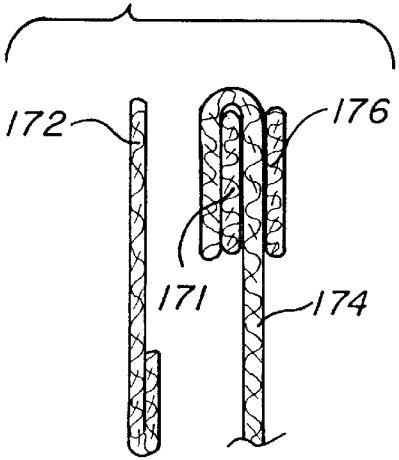
FIG. 17 is a side cut-away view of another locking mechanism, showing a belt extending along the outside of a pants portion.

In FIG. 17, a stretchy belt 176 fits around a pants portion 174, and may be tightened to press the over band 171 against a torso portion 172, and further secure the lock.

In FIGS. 13 and 15, the bands are formed in the same fashion as band 125, described above and shown in FIG. 12*a,* whereas in FIGS. 16 and 17, the band is formed in the same fashion as band 145, described above and shown in FIG. 14. How the band is formed is less important than the resultant inner edge or ridge. In addition, the drawstrings 126, 136, 156, and 166 and belt 176, all of which constitute additional locking bands, are shown as centered, respectively, on the bands 125, 135, 155, 165, and 75. However, centered locking band placement is not essential. Generally, the closer to an inner edge or ridge that the additional locking band is located, the more secure the attachment. It is preferred that the suit 80 be made of a material with at least two-way stretch, to stretch both vertically and horizontally. As seen in FIG. 10, it is not necessary (and in the case of maternity wear, not preferred) for the material from which the suit 100 is made to have a two-way stretch. In order to provide a wearer of such a suit with full range of motion, it is only necessary to provide additional material length in the torso portions 82, 102. The bands 81, 85 and 101, 105 will still interlock, and the amount of material necessary for the torso portion in order to achieve full torso coverage is still decreased from that of a typical shirt/shorts combination.

When the suits 80, 100 are provided with short sleeves and short legs, as seen in FIGS. 8 and 10, they are particularly useful for the man, woman, or child for whom it would be preferable to provide sun protection without the use of sunscreen (which is expensive, must be applied carefully and frequently, and is of questionable health value). The suit 80 is preferable to the T-shirt and bathing trunk combination frequently sported at the beach, because the shirt portion 82 is more aerodynamic for exercise. Further, the suit 80 has less material on the torso portion, so it is easier to dry and more comfortable to wear.

The suit 80 is particularly useful for the bicyclist, wet suit user or unitard wearer, who will have the desired sleek, aerodynamic, non-chafing functionality of his or her conventional garment along with the dressing and undressing convenience provided by the current invention. The suits 80, 100 may have short, long, or no sleeves, and short, long, or no legs.

The invention described herein is useful in many applications in the garment field. As discussed before, it is suggested for use in swimming and exercise apparel. It also has applicability in any garment in which full body coverage and access to the crotch are both desired, such as wet suits, body suits, jumper suits, underwear suits, or children's apparel.

The materials with which garments embodying the current invention are made may be any materials suitable for the intended application. The materials may also be a print, have contrasting colors, have another busy pattern, or have a different texture or weave to facilitate concealing the inventive crotch area exposure mechanism. Further, it may be preferable to provide the exercise garment with a crotch piece made of cotton to maintain good air circulation during prolonged wear, in order to prevent yeast infection, which is a common problem resulting from extended wear of exercise apparel.

Having described preferred embodiments of the invention, it will now become apparent to those of skill in the art that other embodiments incorporating its concepts may be provided. It is felt therefore that this invention should not be limited to the disclosed embodiments but rather should be limited only by the spirit and scope of the appended claims.

What is claimed is:

1. A method of joining a first and second circumferential portion around a circumference, comprising attaching a first band to the interior of said first circumferential portion, said first band having a first band face parallel to said first circumferential portion and a first band inner edge extending between said first band face and said first circumferential portion;

sizing said first band to fit snugly about said circumference;

attaching a second band to the exterior of said second circumferential portion, said second band having a second band face parallel to said second circumferential portion and a second band inner edge extending between said second band face and said second circumferential portion;

forming from said second band face and said second inner edge an outwardly facing ridge extending parallel to said second circumferential portion and disposed to contact an first band inner edge when a over-portion is disposed over said tucked portion;

placing said first circumferential portion over said second circumferential portion, so that said portions fit snugly about said circumference and said bands contact, said first band inner edge and said outwardly facing ridge contacting each other, and said ridge locking said contact, said contact being sufficient to securely, snugly and releasably attach said first portion to said second portion.

2. The method of claim 1, further comprising the step of forming from said first band face and said first band inner edge an inwardly facing ridge on said first band, said inwardly facing ridge extending parallel to said first circumferential portion and disposed to contact said second band inner edge when said over-portion is disposed over said tucked portion; so that when said bands contacts, said inwardly facing ridge contacts said outwardly facing ridge and said ridges interlock, said outwardly facing ridge disposed between said inwardly facing ridge and said first portion and said inwardly facing ridge disposed between said outwardly facing ridge and said second portion, said interlocking being sufficient to securely, snugly and releasably attach said first portion to said second portion.

3. The method of claim 1, further comprising attaching an additional locking band to said first circumferential portion, and tightening said additional locking band to press said first circumferential portion against said second circumferential portion, and said second circumferential portion tightly against said circumference and, thus, to even further secure said releasable attachment.

4. A unitary garment for full or partial coverage of a torso, comprising:

an over-portion having an over band attached along the interior of a circumference thereof, said over band having sufficient circumference to fit snugly about the wearer of the garment, and having an over band face parallel to said over-portion and an over band inner edge extending between said over-portion and said over band face;

a tucked portion having an under band attached along the exterior of the circumference thereof, said the under band having an under the under band face parallel to said tucked portion and a tucked portion inner edge extending between said tucked portion and said under band face;

said tucked portion inner edge and said under band face forming an outwardly facing ridge extending parallel to said tucked portion and disposed to contact said over band inner edge when said over-portion is disposed over said tucked portion, said bands fitting snugly about said wearer and said inner edges contacting each other, said outwardly facing ridge locking said contact;

said locking being sufficient to securely, snugly and releasably attach said garment around the circumference of said wearer.

5. The unitary garment of claim 4, wherein said over-portion comprises a pants portion, said over band comprising a pants band along the circumference of said pants portion, and said tucked portion comprising torso portion having a torso edge portion for disposition within said pants portion, said edge portion having a torso band along the circumference of said torso portion.

6. The unitary garment of claim 4, wherein said over-portion comprises a torso portion, said over band comprising a torso band along the circumference of said torso portion, said tucked portion comprising a pants portion arranged for disposition under said torso portion, said pants portion having a pants band along the circumference of said pants portion.

7. The unitary garment of claim 4, wherein at least one of said bands has selectively sized circumference to allow said circumference to expand and contract in response to the bodily measurements of a wearer of said garment.

8. The unitary garment of claim 4, wherein at least one of said bands be formed of elastic having high rigidity.

9. The unitary garment of claim 4, wherein said over band face and said over band inner edge form an inwardly facing ridge extending parallel to said over-portion and disposed to contact said tucked portion inner edge when said over-portion is disposed over said tucked portion; so that when said over band is fit snugly over said tucked portion and said bands contact, said inwardly facing ridge contacts said outwardly facing ridge and said ridges interlock, said outwardly facing ridge disposed between said inwardly facing ridge and said over-portion and said inwardly facing ridge disposed between said outwardly facing ridge and said tucked portion, said interlocking being sufficient to securely, snugly and releasably attach said garment around the circumference of said wearer.

10. A locking mechanism for joining an over-portion and a tucked portion around a first circumference, comprising:

an over band attached along the interior of the circumference of said over-portion, said over band having sufficient circumference to fit snugly about said first circumference, and having an over band face parallel to said over-portion and an over band inner edge extending between said over-portion and said over band face; and an under band attached along the exterior of the circumference of said tucked portion, said under band having an under band face parallel to said tucked portion and a tucked portion inner edge extending between said tucked portion and said under band face;

said tucked portion inner edge and said under band face forming an outwardly facing ridge extending parallel to said tucked portion and disposed to contact said over band inner edge when said over-portion is disposed over said tucked portion, said bands fitting snugly about said first circumference and said inner edges contacting each other, said outwardly facing ridge locking said contact;

said locking being sufficient to cause secure, snug and releasable attachment of said over-portion and said tucked portion.

11. The locking mechanism of claim 10, in which said over band face and said over band inner edge form an inwardly facing ridge extending parallel to said over-portion and disposed to contact said tucked portion inner edge when said over-portion is disposed over said tucked portion, so that when said over band is fit snugly over said tucked portion and said bands contact, said inwardly facing ridge contacts said outwardly facing ridge and said ridges interlock, said outwardly facing ridge disposed between said inwardly facing ridge and said over-portion and said inwardly facing ridge disposed between said outwardly facing ridge and said tucked portion, said interlocking being sufficient to securely, snugly and releasably attach said over-portion and said tucked portion.

12. The locking mechanism of claim 11, in which said ridges are approximately the same height.

13. The locking mechanism of claim 11, wherein said ridges are no more than about half the height of said bands.

14. The locking mechanism of claim 11, wherein said outwardly facing ridge is significantly deeper than said inwardly facing ridge.

15. The locking mechanism of claim 11, wherein said bands are formed of thick elastic.

16. The unitary garment of claim 10, in which said over-portion has an additional locking band positioned thereon abutting said over band, said locking band pressing against said tucked portion and pressing said tucked portion against said first circumference, whereby said releasable attachment is even further secured.

17. The unitary garment of claim 16, in which said additional locking band is exterior to said over band and presses said over band against said tucked portion.

18. The unitary garment of claim 16, in which said additional locking band is inside said over-portion, entering and exiting said over-portion through a hole that extends through said over band.

19. A locking mechanism for joining a tucked portion to an over-portion about a first circumference, said over-portion having an over band attached along the interior of the circumference thereof, said over band having sufficient circumference to fit snugly about said first circumference and having an over band face parallel to said over-portion and an over band inner edge extending between said over-portion and said over band face; said locking mechanism comprising:

an under band attached along the exterior of the circumference of said tucked portion, said under band having an under band face parallel to said tucked portion and a tucked portion inner edge extending between said tucked portion and said under band face;

said tucked portion inner edge and said under band face forming an outwardly facing ridge extending parallel to said tucked portion and disposed to contact said over band inner edge when said over-portion is disposed over said tucked portion, said bands fitting snugly about said a first circumference and said inner edges contacting each other, said outwardly facing ridge locking said contact.

20. The locking mechanism of claim 19, wherein said ridge is no more than about half the height of said under band.

* * * * *

UNITED STATES PATENT AND TRADEMARK OFFICE

CERTIFICATE OF CORRECTION

PATENT NO. : 5,956,765
DATED : 28 September 1999
INVENTOR(S) : May Y. Chin

It is certified that error appears in the above-identified patent and that said Letters Patent is hereby corrected as shown below:

On the title page, item [75],

Under "Inventor:" delete

"22 Indian Springs Way, Wellesley, Mass. 02181", and replace with

–30 Goodman's Hill Road, Sudbury, Mass. 01776–.

Signed and Sealed this

Eighteenth Day of July, 2000

*Attest:*

Q. TODD DICKINSON

*Attesting Officer*

*Director of Patents and Trademarks*